United States Patent [19]

Williams

[11] 4,181,075

[45] Jan. 1, 1980

[54] BUMPER-PRESS PRINTING DEVICE

[76] Inventor: Winston D. Williams, P.O. Box 22791, Tampa, Fla. 33622

[21] Appl. No.: 894,478

[22] Filed: Apr. 7, 1978

[51] Int. Cl.[2] ..... B41F 3/02; B41F 3/20; B41B 1/18; B41B 11/40

[52] U.S. Cl. ..... 101/269; 101/392; 101/393; 101/394

[58] Field of Search ..... 101/391, 392, 393, 394, 101/396, 269, 377, 402, 403

[56] References Cited

U.S. PATENT DOCUMENTS

| | | | |
|---|---|---|---|
| 134,705 | 1/1873 | Ross | 101/269 |
| 1,006,667 | 10/1911 | McClellan | 101/393 X |
| 1,924,288 | 8/1933 | Reardon | 101/269 |
| 2,146,036 | 2/1939 | Tunis et al. | 101/392 |
| 3,124,067 | 3/1964 | Morgan | 101/394 |
| 3,358,599 | 12/1967 | Douglass, Sr. | 101/394 |

FOREIGN PATENT DOCUMENTS

| | | | |
|---|---|---|---|
| 357018 | 9/1931 | United Kingdom | 101/394 |

*Primary Examiner*—J. Reed Fisher

[57] ABSTRACT

This invention relates to an improvement in printing devices whereby type may be set and bumper stickers and other items printed with an increase in speed and convenience on equipment of inexpensive design by providing a system of slots which line up metal type and then lock them in place for printing.

1 Claim, 1 Drawing Figure

FIGURE I
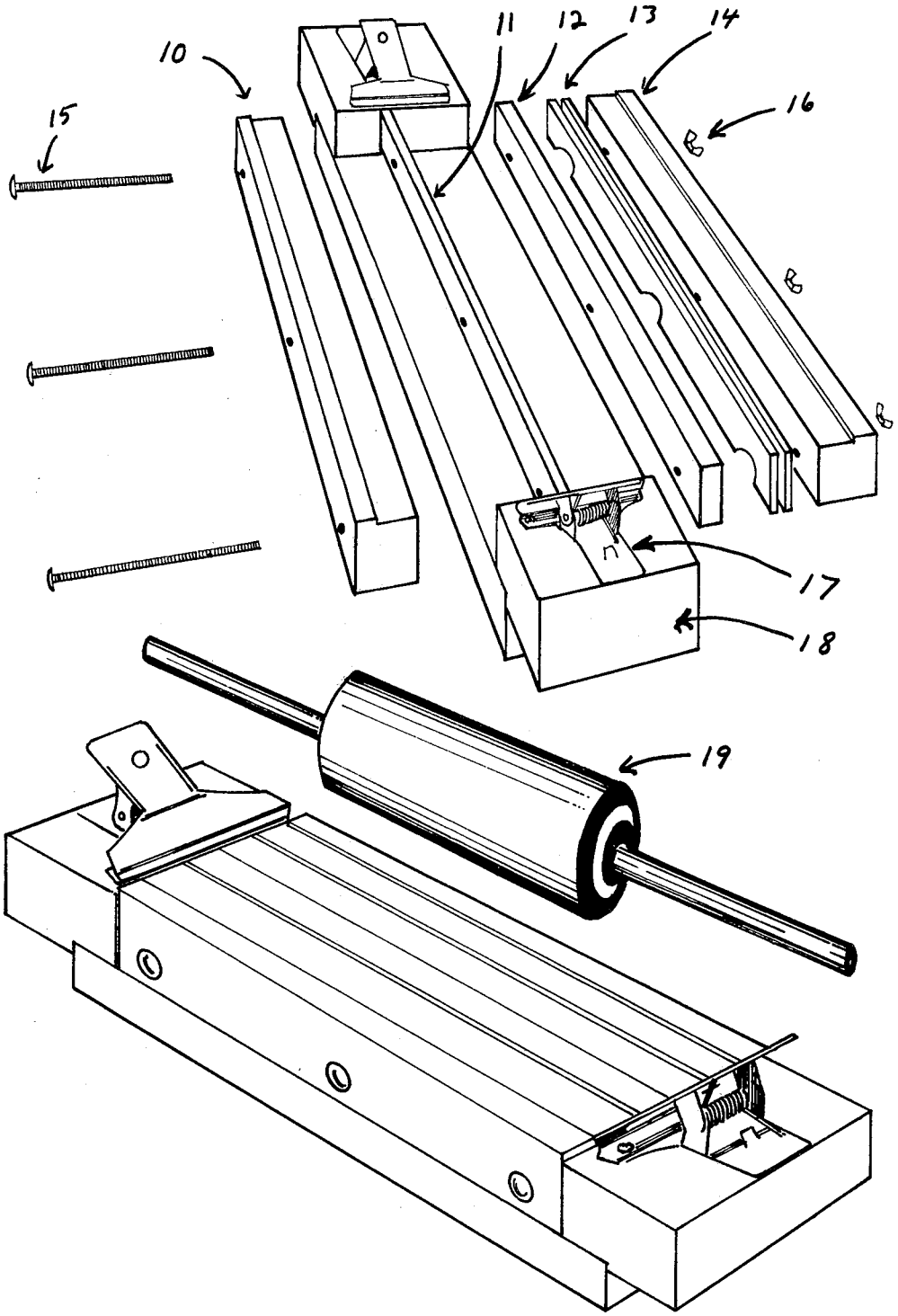

BUMPER-PRESS PRINTING DEVICE

BACKGROUND OF THE INVENTION

The present practice in letterpress printing is to place type in a chase and provide spaces between lines of type with spacing strips known as "leads and slugs" and provide spacing between words with other spacing material known as "quads and spaces". The whole array of type and spacing material is then locked in place inside the chase with expansion devices known as "quoins". For the quoins to work properly, the lines of type and spacing material must be very accurately spaced out to exactly the proper length, a time consuming process.

SUMMARY OF THE INVENTION

The present invention relates to a printing device with slots designed to accept and hold the slug upon which metal type commonly known as "Ludlow type" is cast. The type is cut into individual characters, each character is dropped into the slot to form a line of type, then the slot is tightened by a screw arrangement to hold the type in place for printing. The type is automatically aligned in a straight array. The use of multiple slots allows a number of lines of type to be set and printed at one time. The design also allows for the printing of a lesser number of lines of type without adjustment.

BRIEF DESCRIPTION OF THE DRAWING

FIG. 1 includes an exploded view of the "Bumper-Press," a view of the pressure roller to be used with the "Bumper-Press", and a view of the assembled parts of the "Bumper-Press", all in perspective

DETAILED DESCRIPTION

As shown in FIG. I, the device consists of a series of dividers, (numbers 10, 11, 12, and 14) locked together with bolts (15) and wing-nuts (16) in such a manner that slots are created between dividers (10) and (11), between (11) and (12), and between (12) and (14). When the bolts and wing-nuts are loosened, anyone of these slots or all of them may be widened so that individual pieces of "Ludlow" or similar type may be inserted, the slug of the type dropping into the slot and the face of the type held above the slot, and then type locked into place by tightening the wing-nuts on the bolts. A piece of bumper-sticker paper blank or other material to be printed is inserted in the device after the type has been inked and the material to be printed is held in place by the springclips (17) shown at both ends. The hand roller (19) is then used to apply pressure to force the material to be printed against the inked type. The material is then removed from the device.

It should be noted that the space divider (11) is permanently affixed to the frame (18) so that the entire set of space dividers is held together in the proper arrangement with the bolts although the slots can be widened by moving the dividers when the wing-nuts have not been tightened on the bolts. The outer dividers on both sides, (10) and (14), have an additional raised edge. The function of this edge is to provide a guide for the pressure roller and to prevent the pressure roller from forcing the material to be printed beneath the level of the type where it might pick up ink from areas not intended to be printed. The face of the type, when in place in the "bumper-press", is higher than these raised edges so that the roller applies pressure from the object to be printed onto the type faces. The spacers shown at number (13) may be place in any of the slots to provide more spacing between the lines of type. They are designed with curved openings at the bottom to allow them to fit over the bolts.

Now that the invention has been described, what is claimed is:

1. A printing device comprising in combination:

a type holder with adjustable slots for holding individual type elements so as to form one or more lines of type, said holder including a frame member (18) having a base portion defined by an upper and lower surface with the lower surface forming a horizontal supporting face; opposite ends of said base portion each having an upstanding wall member, an inner vertical face of each said wall members being spaced apart and parallel relative to one another;

a horizontal upper surface of each said wall member having a spring clip member for holding opposite edges of a material to be printed;

a stationary space divider (11) affixed to said upper surface of said base portion and extending between and connected to said inner vertical faces of said upstanding wall members, said space divider having a vertically extending face on each side thereof;

said base portion top surface and said vertical faces of said upstanding wall members forming a channel configuration on each side of said space divider (11);

a plurality of freely slidable space dividers (10, 12, 13, 14), at least one said slidable space divider being insertable into each said channel so as to form at least one adjustable slot defined by each said slidable space divider and the respective said vertical extending face of said stationary space divider (11) whereby each said slot may be adjusted to conform with a line of type insertable therein;

means extending through each said stationary and slidable space dividers for clamping the said slidable space dividers to said stationary space divider and to one another so that said space dividers are held together on said frame for thus securing said at least one line of type;

a hand roller for application of pressure for forcing the material to be printed against said line of type;

the outermost ones of said slidable space dividers each having a raised edge so as to form spaced raised edges with the said at least one line of type therebetween for thus preventing the said pressure roller from touching any part of the type holder beneath the level of the type faces or forcing the material to be printed against any part of the type holder beneath the level of the type faces.

* * * * *